US010100264B2

(12) United States Patent
Zhao et al.

(10) Patent No.: US 10,100,264 B2
(45) Date of Patent: Oct. 16, 2018

(54) EXPERIMENTAL LOOP SYSTEM FOR FLUIDIZATION EXPLOITATION OF SOLID-STATE MARINE GAS HYDRATE

(71) Applicant: SOUTHWEST PETROLEUM UNIVERSITY, Chengdu (CN)

(72) Inventors: Jinzhou Zhao, Chengdu (CN); Yanjun Liu, Chengdu (CN); Leilei Jiang, Chengdu (CN); Shouwei Zhou, Chengu (CN); Mi Zhang, Chengdu (CN); Ping Guo, Chengdu (CN); Guorong Wang, Chengdu (CN); Qingping Li, Chengdu (CN); Zhiqiang Huang, Chengdu (CN)

(73) Assignee: SOUTHWEST PETROLEUM UNIVERSITY, Chengdu (CN)

( * ) Notice: Subject to any disclaimer, the term of this patent is extended or adjusted under 35 U.S.C. 154(b) by 55 days.

(21) Appl. No.: 15/454,801

(22) Filed: Mar. 9, 2017

(65) Prior Publication Data

US 2017/0260469 A1 Sep. 14, 2017

(30) Foreign Application Priority Data

Mar. 11, 2016 (CN) ..... 2016 1 0139992

(51) Int. Cl.
*B01J 19/00* (2006.01)
*C10L 3/10* (2006.01)

(52) U.S. Cl.
CPC ..... *C10L 3/108* (2013.01); *C10L 3/107* (2013.01); *C10L 2290/10* (2013.01); *C10L 2290/58* (2013.01); *C10L 2290/60* (2013.01)

(58) Field of Classification Search
CPC .. C10L 3/10; C10L 3/108; C10L 3/107; B01J 19/00
USPC ..... 422/187
See application file for complete search history.

(56) References Cited

U.S. PATENT DOCUMENTS 8,921,626 B2 * 12/2014 Takahashi ..... C10L 3/06 48/127.3
2009/0235586 A1 * 9/2009 Katoh ..... C10L 3/108 48/127.9

FOREIGN PATENT DOCUMENTS

CN 103103004 * 5/2013 ..... B01J 3/00

* cited by examiner

*Primary Examiner* — Huy Tram Nguyen
(74) *Attorney, Agent, or Firm* — Cooley LLP

(57) ABSTRACT

The present disclosure provides an experimental loop system for fluidization exploitation of solid-state marine gas hydrate, comprising: four modules, namely a gas hydrate sample large-amount and rapid preparation module, a gas hydrate multi-scale smashing and slurry fidelity transfer module, a gas hydrate slurry pipeline conveying characteristic experiment module, and a data collection and monitoring and safety control module. The gas hydrate experimental loop device provided by the present disclosure may be used for researching the synthesis, decomposition, gas storage rate and phase equilibrium of gas hydrate, and researching the pipeline conveying flow resistance and heat transfer characteristics, and is significant for solving the blockage problem in the gas pipeline conveying process, storage and conveying of the gas hydrate, solid-state fluidization exploitation of the marine gas hydrate and pipeline conveying experimental simulation thereof.

10 Claims, 2 Drawing Sheets

EXPERIMENTAL LOOP SYSTEM FOR FLUIDIZATION EXPLOITATION OF SOLID-STATE MARINE GAS HYDRATE

RELATED APPLICATIONS

The subject application claims priority to and benefit of Chinese Patent Application No. 201610139992.5 filed Mar. 11, 2016, entitled, "Experimental Loop System for Fluidization Exploitation of Solid-State Marine Gas Hydrate", the entire disclosure of which is herein incorporated by reference.

TECHNICAL FIELD

The present disclosure relates to the technical field of gas hydrate exploitation and utilization thereof, and more particularly, to an experimental loop system for fluidization exploitation of solid-state marine gas hydrate.

BACKGROUND

Gas hydrate is a non-stoichiometric supramolecular cage compound. 1 $m^3$ of hydrate may store 160~180 $m^3$ of gas. Characterized by a wide distribution range, a large reservoir-forming size and a high energy density, the gas hydrate is generally regarded as an important alternative energy source in the $21^{st}$ century. At present, a laboratory simulation based on traditional exploitation methods such as heat injection, depressurization, agent injection and so on, has been carried out throughout the world. However, fundamental theories, potential security risks, environmental risks and cost risks in the gas hydrate exploitation are not solved yet, and yet no fundamental breakthrough occurs to technical bottlenecks. Therefore, researches of flow and heat transfer characteristics of the gas hydrate in pipelines are of strategic significance to the exploitation of the marine gas hydrate.

SUMMARY

It is an objective of the present disclosure to provide an experimental loop system for fluidization exploitation of solid-state marine gas hydrate aiming at the above problems.

An experimental loop system for fluidization exploitation of solid-state marine gas hydrate includes four modules, namely a gas hydrate sample large-amount and rapid preparation module, a gas hydrate multi-scale smashing and slurry fidelity transfer module, a gas hydrate slurry pipeline conveying characteristic experiment module and a data collection and monitoring and safety control module, wherein:

the gas hydrate sample large-amount and rapid preparation module comprises a gas conveying pipeline, a liquid conveying pipeline, a spraying device, a bubbling device, and a stirring device;

wherein the gas conveying pipeline is used for conveying gas in a gas cylinder into a reaction kettle, and the pipeline is connecting an outlet of the gas cylinder with a gas inlet a at a bottom of the reaction kettle;

the liquid conveying pipeline is used for conveying water in a water tank into the reaction kettle, and the liquid conveying pipeline on which a plunger pump is disposed, is connecting an outlet of the water tank with a liquid-phase inlet c of the reaction kettle;

the spraying device includes a sprayer disposed at a top of the reaction kettle, and the sprayer is communicated with the liquid-phase inlet c of the reaction kettle through a pipeline on which a liquid circulation pump is disposed;

the bubbling device includes a bubbler disposed at a bottom of the reaction kettle;

the stirring device is provided with a stirrer in the reaction kettle, a stirring and smashing paddle of the stirrer is in the form of a propeller blade, and a smashing awl is provided at a bottom of the blade;

the gas hydrate multi-scale smashing and slurry fidelity transfer module includes two parts, namely a mixed-phase gas hydrate fidelity transfer pipeline and a water pipeline, wherein the mixed-phase gas hydrate fidelity transfer pipeline is connecting a mixed-phase outlet i of the reaction kettle with an inlet of a circulating pump, the water pipeline is connecting the water tank with the inlet of the circulating pump, and after further mixing by means of the circulating pump, the two parts are connected with the gas hydrate slurry pipeline conveying characteristic experiment module;

the gas hydrate slurry pipeline conveying characteristic experiment module includes a vertical pipeline conveying loop, a horizontal pipeline conveying loop and a high-pressure transparent visible pipe;

the vertical pipeline conveying loop includes a vertical pipeline connected with an outlet of the circulating pump, the horizontal pipeline conveying loop includes a horizontal pipeline connected with the outlet of the circulating pump, and the vertical pipeline conveying loop and the horizontal pipeline conveying loop are respectively provided with an on-line particle size measuring instrument, a pipeline heater and a high-pressure transparent visible pipe;

the data collection and monitoring and safety control module includes a computer and a resistivity measurement point C, a pressure measurement point P, a temperature measurement point T, a liquid level measurement point L, a single-phase/multiphase fluid flow measurement point F and a motor parameter measurement point M that are connected with the computer.

Further, in the above-mentioned experimental loop system for fluidization exploitation of solid-state marine gas hydrate, the gas conveying pipeline includes a gas bypass regulating circulation loop for pumping out unreacted gas in the reaction kettle from a gas outlet b at a top of the reaction kettle back into the gas inlet a at the bottom of the reaction kettle by means of a gas circulation pump.

Further, in the above-mentioned experimental loop system for fluidization exploitation of solid-state marine gas hydrate, the gas bypass regulating circulation loop is provided with a gas protection circulation loop for protecting the gas circulation pump, and the gas protection circulation loop consists of following parts connected in sequence: an outlet of the gas circulation pump, a second regulating valve, a fourth pressure indicator, a fourth temperature indicator, a fourth regulating valve, a first gas flowmeter, a second pressure indicator, a second temperature indicator, and an inlet of the gas circulation pump.

Further, in the above-mentioned experimental loop system for fluidization exploitation of solid-state marine gas hydrate, the spraying device includes a protection circulation loop for protecting the liquid circulation pump, and the protection circulation loop specifically consists of following parts connected in sequence: an outlet of the liquid circulation pump, a seventh regulating valve, a seventh temperature indicator, a seventeenth pressure indicator, a first liquid flowmeter, a ninth regulating valve, a sixth temperature indicator, a sixteenth pressure indicator, and an inlet of the liquid circulation pump.

Further, in the above-mentioned experimental loop system for fluidization exploitation of solid-state marine gas hydrate, the gas hydrate sample large-amount and rapid preparation module includes a pressure stabilizing pipeline for maintaining pressure inside the reaction kettle to be constant or to be in a desired pressure condition, and the pressure stabilizing pipeline consists of two parts, namely a liquid-phase pipeline and a gas-phase pipeline;

the liquid-phase pipeline consists of following parts connected in sequence through pipelines: the water tank, the plunger pump, a liquid-phase inlet d and a liquid-phase outlet e at a bottom of a pressure stabilizing buffer tank, and a second drain valve;

the gas-phase pipeline consists of following parts connected in sequence through pipelines: the outlet of the gas cylinder, a gas-phase inlet f at a top of the pressure stabilizing buffer tank, a gas-phase outlet g of the pressure stabilizing buffer tank, and the gas inlet a at the bottom of the reaction kettle.

Further, in the above-mentioned experimental loop system for fluidization exploitation of solid-state marine gas hydrate, the pressure stabilizing buffer tank is further connected with a vacuum pump.

Further, in the above-mentioned experimental loop system for fluidization exploitation of solid-state marine gas hydrate, the mixed-phase gas hydrate fidelity transfer pipeline further includes a filter screen disposed at the mixed-phase outlet i of the reaction kettle.

Further, in the above-mentioned experimental loop system for fluidization exploitation of solid-state marine gas hydrate, the gas hydrate multi-scale smashing and slurry fidelity transfer module further includes a pressure balance detection pipeline for ensuring that the pressure in the mixed-phase gas hydrate fidelity transfer pipeline, in the gas hydrate slurry pipeline conveying pipeline and in the reaction kettle right after a large-amount and rapid preparation of the gas hydrate, keep consistent before the mixed-phase gas hydrate is mixed with water;

the pressure balance detection pipeline is constituted by communicating an outlet e of the pressure stabilizing buffer tank with an intersection between the mixed-phase gas hydrate fidelity transfer pipeline and the water pipeline.

Further, in the above-mentioned experimental loop system for fluidization exploitation of solid-state marine gas hydrate, the gas hydrate slurry pipeline conveying characteristic experiment module further includes a protection pipeline for protecting the vertical pipeline conveying loop and the horizontal pipeline conveying loop, which protection pipeline consists of following parts connected in sequence:

the outlet of the circulating pump, a nineteenth pressure indicator, a thirteenth regulating valve, an eleventh regulating valve, a third liquid flowmeter, a pressure regulator, and the inlet of the circulating pump.

Further, in the above-mentioned experimental loop system for fluidization exploitation of solid-state marine gas hydrate, an intersection between the horizontal pipeline conveying loop and the vertical pipeline conveying loop is further connected with a three-phase separator.

The present invention may be used for researching the synthesis, decomposition, gas storage rate and phase equilibrium characteristics of the gas hydrate as well as flow resistance and heat transfer characteristics in pipeline thereof, for exploring solutions to large-scale exploitation and storage and conveying of the gas hydrate, for solving the problem of lack of theory in the current exploitation process of the gas hydrate, and for providing technical and theoretical supports to the exploitation and conveying of the marine gas hydrate, thereby promoting the industrialization process in the exploitation of the marine gas hydrate.

DETAILED DESCRIPTION OF THE EMBODIMENTS

To further clarify the objectives, technical solutions, and advantages of the present disclosure, the technical solutions in the present disclosure will be described clearly and completely hereinafter. Apparently, the described embodiments are some but not all of the embodiments of the present disclosure. All other embodiments obtained by a person of ordinary skilled in the art based on the embodiments of the present disclosure without creative efforts shall fall within the protection scope of the present disclosure.

Figure 1:
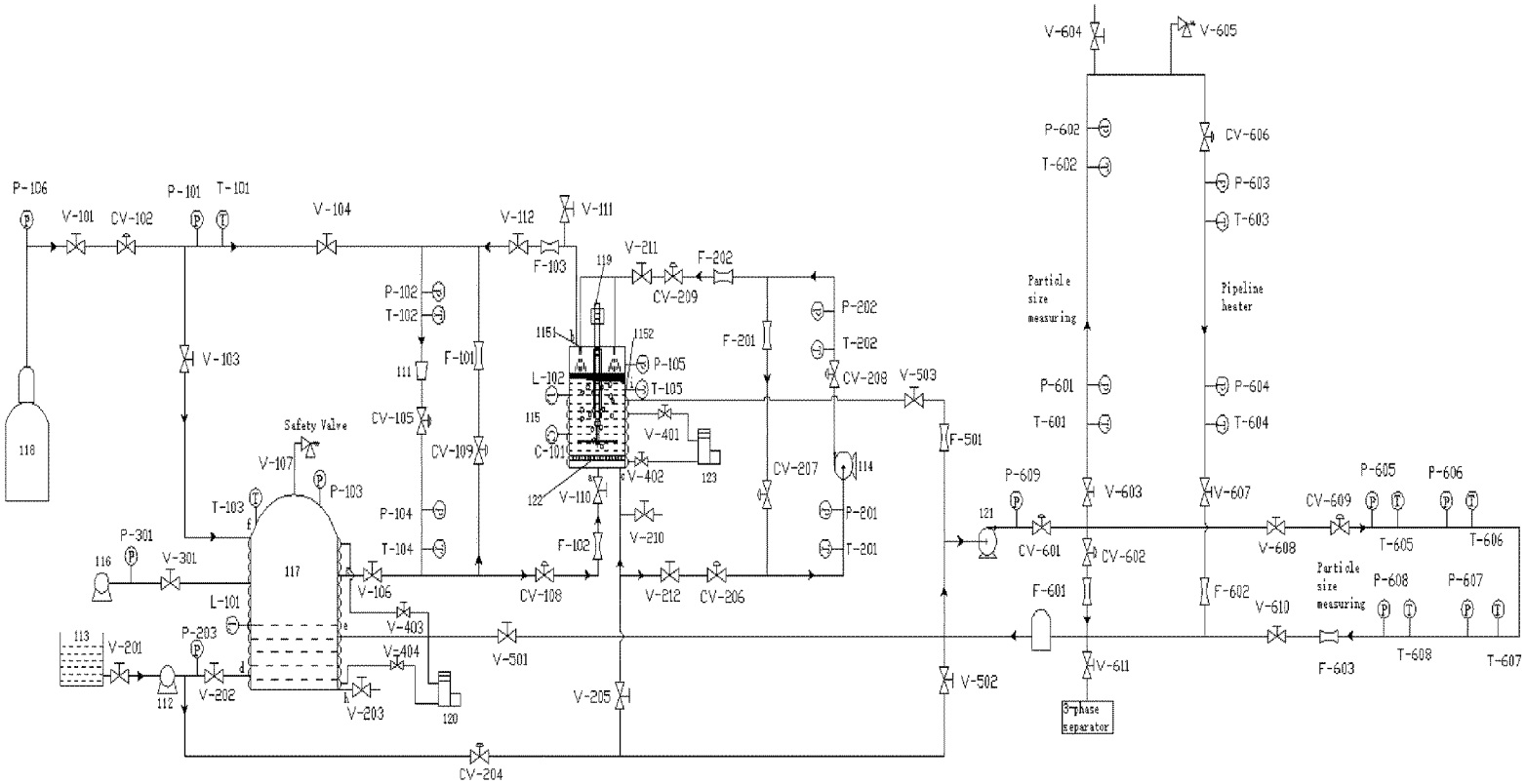
FIG. 1 is a structural diagram of an experimental loop system for fluidization exploitation of solid-state marine gas hydrate according to the present disclosure.
Figure 2:
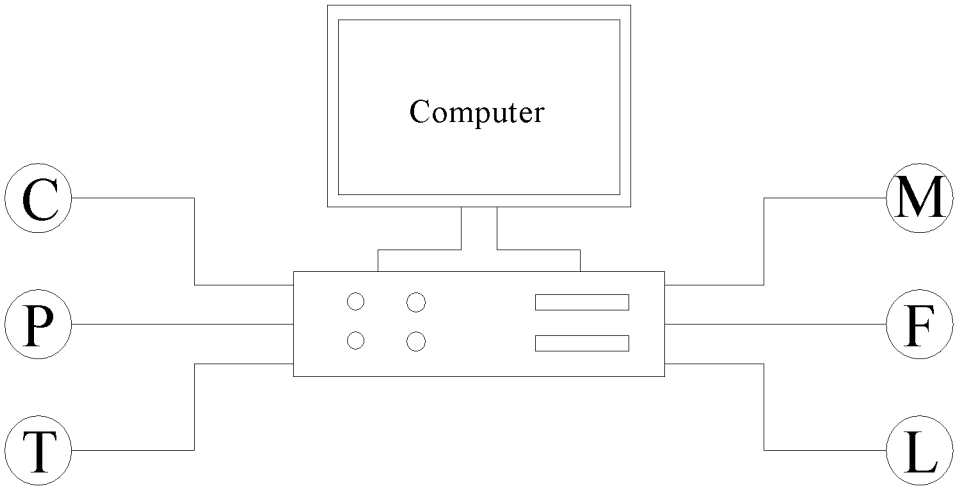
FIG. 2 is a structural diagram of a data collection and monitoring and safety control module according to the present disclosure.

As shown in FIG. 1 and FIG. 2, the present disclosure provides an experimental loop system for fluidization exploitation of solid-state marine gas hydrate, including: four modules, namely a gas hydrate sample large-amount and rapid preparation module, a gas hydrate multi-scale smashing and slurry fidelity transfer module, a gas hydrate slurry pipeline conveying characteristic experiment module, and a data collection and monitoring and safety control module, wherein:

the gas hydrate sample large-amount and rapid preparation module includes a gas cylinder 118, a reaction kettle 115, a water tank 113, a pressure stabilizing buffer tank 117, a gas circulation pump 111, a liquid circulation pump 114, a reaction kettle refrigerating unit 123, a pressure stabilizing buffer tank refrigerating unit 120, a liquid level meter, a plurality of shutoff valves, regulating valves, flowmeters (gas and liquid), temperature indicators, and pressure indicators. A bubbler 122 is disposed at the bottom of the reaction kettle 115, at the bottom of the bubbler 122 there is provided with a gas-phase inlet a connected with the gas cylinder 118 through the gas circulation pump 111. At the top of the reaction kettle 115 there is provided with a sprayer 1151 connected with the water tank 113 through the liquid circulation pump 114 and a liquid circulation pipeline. The reaction kettle 115 is internally provided with a stirrer 119. At the top of the reaction kettle 115 there is also provided with a gas-phase outlet b connected with the gas circulation pump 111 and a gas circulation pipeline. At the bottom of the pressure stabilizing buffer tank 117 there is provided with a liquid-phase inlet d connected with the water tank 113 through a plunger pump 112. At the top of the pressure stabilizing buffer tank 117 there is provided with a gas-phase inlet f connected with the gas cylinder 118, and a gas-phase outlet g connected with a gas-phase inlet at the bottom of the reaction kettle respectively, wherein the pressure stabilizing buffer tank 117 is further connected with a vacuum pump 116. Particularly, on outer walls of the reaction kettle and the pressure stabilizing buffer tank there are respectively provided with an electric heating device and a cooling water jacket connected with the refrigerating unit.

Specifically, the gas hydrate sample large-amount and rapid preparation module includes five parts, namely a gas conveying pipeline, a gas bypass regulating circulation loop, a liquid conveying pipeline, a spraying bypass circulation loop and a pressure stabilizing pipeline;

wherein the gas conveying pipeline is used for conveying gas in the gas cylinder 118 into the reaction kettle 115, and consists of following parts connected in sequence: the gas cylinder 118, a sixth pressure indicator P-106, a first shutoff valve V-101, a first regulating valve CV-102, a first pressure indicator P-101, a first temperature indicator T-101, a fourth shutoff valve V-104, a second pressure indicator P-102, a second temperature indicator T-102, the gas circulation pump 111, a second regulating valve CV-105, a fourth pressure indicator P-104, a fourth temperature indicator T-104, a third regulating valve CV-108, a second gas flowmeter F-102, a sixth shutoff valve V-110, and a gas inlet a at the bottom of the reaction kettle 115;

the gas bypass regulating circulation loop is used for pumping out unreacted gas in the reaction kettle 115 from a gas outlet b at the top of the reaction kettle back into the gas inlet a at the bottom of the reaction kettle 115 by means of the gas circulation pump 111, and consists of following parts connected in sequence: the gas outlet b on the top of the reaction kettle, a third gas flowmeter F-103, a fifth shutoff valve V-112, the second pressure indicator P-102, the second temperature indicator T-102, the gas circulation pump 111, the second regulating valve CV-105, the fourth pressure indicator P-104, the fourth temperature indicator T-104, the third regulating valve CV-108, the second gas flowmeter F-102, the sixth shutoff valve V-110, and the gas inlet a at the bottom of the reaction kettle 115.

Preferably, to ensure that the gas circulation pump 111 can be operated properly and safely, the present disclosure further provides the gas circulation pump 111 with a gas protection circulation loop for protecting the gas circulation pump. The gas protection circulation loop consists of following parts connected in sequence: an outlet of the gas circulation pump 111, the second regulating valve CV-105, the fourth pressure indicator P-104, the fourth temperature indicator T-104, a fourth regulating valve CV-109, a first gas flowmeter F-101, the second pressure indicator P-102, the second temperature indicator T-102, and an inlet of the gas circulation pump 111.

The liquid conveying pipeline is used for conveying water in the water tank 113 into the reaction kettle 115, and specifically consists of following parts connected in sequence: the water tank 113, a seventh shutoff valve V-201, the plunger pump 112, a fifth regulating valve CV-204, an eighth shutoff valve V-205, and a liquid-phase inlet c of the reaction kettle.

Further, to increase a reaction area for liquid and gas, in the present disclosure, a spraying device is also disposed at the top of the reaction kettle. Synthesis of the gas hydrate is accelerated by means of a spraying bypass circulation loop which specifically consists of following parts connected in sequence: the liquid-phase inlet c of the reaction kettle, a ninth shutoff valve V-212, a sixth regulating valve CV-206, a sixth temperature indicator T-201, a sixteenth pressure indicator P-201, the liquid circulation pump 114, a seventh regulating valve CV-208, a seventh temperature indicator T-202, a seventeenth pressure indicator P-202, a second liquid flowmeter F-202, an eighth regulating valve CV-209, a tenth shutoff valve V-211, and the sprayer 1151 at the top of the reaction kettle 115.

Preferably, to ensure that the liquid circulation pump 114 can be operated safely and properly, in the present disclosure, a protection circulation loop is also designed for the liquid circulation pump 114. The protection circulation loop specifically consists of following parts connected in sequence: an outlet of the liquid circulation pump 114, the seventh regulating valve CV-208, the seventh temperature indicator T-202, the seventeenth pressure indicator P-202, a first liquid flowmeter F-201, a ninth regulating valve CV-207, the sixth temperature indicator T-201, the sixteenth pressure indicator P-201, and an inlet of the liquid circulation pump 114.

The pressure stabilizing pipeline is used for maintaining pressure inside the reaction kettle to be constant or to be in a desired pressure condition, and the pressure stabilizing pipeline includes two parts, namely a liquid-phase pipeline and a gas-phase pipeline. The liquid-phase pipeline consists of following parts connected in sequence: the water tank 113, the seventh shutoff valve V-201, the plunger pump 112, an eighteenth pressure indicator P-203, an eleventh shutoff valve V-202, the liquid-phase inlet d and a liquid-phase outlet h at the bottom of the pressure stabilizing buffer tank 117, and a second drain valve V-203. The gas-phase pipeline consists of following parts connected in sequence: the gas cylinder 118, the sixth pressure indicator P-106, the first shutoff valve V-101, the first regulating valve CV-102, a third shutoff valve V-103, the gas-phase inlet f at the top of the pressure stabilizing buffer tank 117, the gas-phase outlet g of the pressure stabilizing buffer tank 117, a sixth shutoff valve V-106, the third regulating valve CV-108, the second gas flowmeter F-102, the sixth shutoff valve V-110, and the gas inlet a at the bottom of the reaction kettle 115. The liquid-phase pipeline of the pressure stabilizing pipeline is used for injecting liquid into the pressure stabilizing buffer tank, and the gas-phase pipeline is used for injecting gas into the pressure stabilizing buffer tank. As the liquid level gradually rises and gas in the tank gradually increases, gas pressure of the tank gradually increases under the trend of gradual rising of the liquid level. When the pressure in the reaction kettle is insufficient, a certain amount of gas may be supplied for the reaction kettle through the gas-phase outlet g of the pressure stabilizing buffer tank, or water is pumped from the water tank 113 into the pressure stabilizing buffer tank by means of the plunger pump 112 to increase the pressure of the pressure stabilizing buffer tank 117 and the reaction kettle 115. When the pressure in the reaction kettle is sufficient, water in the pressure stabilizing buffer tank may be drained off via a second drain valve V-203 to reduce the pressure of the tank, or the pressure in the pressure stabilizing buffer tank is reduced by means of the vacuum pump 116.

In the present disclosure, on the pressure stabilizing buffer tank 117 there is further provided with a third temperature indicator T-103, a second safety valve V-107, a third pressure indicator P-103 and a first liquid level indicator L-101.

Further, in the present disclosure, on the pressure stabilizing buffer tank 117 there is the pressure stabilizing buffer tank refrigerating unit 120, both ends of which are respectively connected with an enclosure of the pressure stabilizing buffer tank 117 to refrigerate the same. A pipeline between the refrigerating unit 120 and the pressure stabilizing buffer tank 117 is respectively provided with a twenty-second shutoff valve V-403 and a twenty-third shutoff valve V-404.

Further, the pressure stabilizing buffer tank 117 is also connected with the vacuum pump 116, and a pipeline between the vacuum pump 116 and the pressure stabilizing buffer tank 117 is provided with a seventh pressure indicator P-301 and an eighteenth shutoff valve V-301.

Further, the reaction kettle 115 is internally provided with a stirrer 119. A stirring and smashing paddle of the stirrer 119 is in the form of a propeller blade in order to increase a contact area for gas and liquid so as to accelerate synthesis of gas hydrate, and a smashing awl is provided at the bottom of the blade to smash, in the gas hydrate multi-scale smashing process, the gas hydrate into solid gas hydrate lumps having desired particle sizes for slurry fidelity transfer.

Further, at the bottom inside the reaction kettle 115 there is provided with the bubbler 122 for increasing the contact area for gas and liquid so as to accelerate the synthesis of the gas hydrate.

Based on above, when the gas hydrate is prepared and synthesized according to the present disclosure, the gas hydrate is synthesized by means of an reaction of gas injected from the bottom of the reaction kettle and liquid in the reaction kettle. Furthermore, in order to improve the efficiency of synthesizing the gas hydrate, the present disclosure increases the contact area for the gas and the liquid by means of a combination of stirring, bubbling and spraying so as to accelerate the synthesis of the gas hydrate.

Further, on the reaction kettle 115 there is also provided with a second liquid level indicator L-102, a resistivity indicator C-101, a fifth temperature indicator T-105 and a fifth pressure indicator P-105 to measure real-time statuses of the reaction kettle.

Further, at a mixed-phase outlet i of the reaction kettle 115 there is provided with a filter screen 1152 for filtering solid gas hydrate lumps not reaching particle sizes desired for gas hydrate fidelity transfer and pipeline conveying, and for recrushing until reaching the particle sizes desired for gas hydrate fidelity transfer and pipeline conveying, and thereby an objective of preventing pipeline from blockage is achieved.

Further, on the reaction kettle 115 there is provided with a reaction kettle refrigerating unit 123, both ends of which are respectively connected with an enclosure of the reaction kettle 115. A pipeline between the reaction kettle refrigerating unit 123 and the reaction kettle 115 is respectively provided with a twenty-fourth shutoff valve V-401 and a twenty-fifth shutoff valve V-402.

Further, on a connecting pipeline of the liquid-phase inlet c of the reaction kettle there is provided with a first drain valve V-210; and on a connecting pipeline of the gas-phase outlet b of the reaction kettle there is provided with an exhaust valve V-111.

The gas hydrate multi-scale smashing and slurry fidelity transfer module includes the water tank 113, the reaction kettle 115, the pressure stabilizing buffer tank 117, the filter screen 1152, a plurality of shutoff valves, regulating valves, flowmeters (multiphase of gas, liquid and solid), temperature indicators, and pressure indicators; wherein a fidelity transfer pipeline is connected with the reaction kettle 115 through the filter screen 1152, and with the pressure stabilizing buffer tank 117 through the plunger pump 112, respectively. After the mixed-phase gas hydrate smashed and stirred by the reaction kettle is further mixed with water from the water tank while passing through the fidelity transfer pipeline, the fidelity transfer pipeline is connected to a gas hydrate pipeline conveying characteristic experiment platform via the circulating pump 121 (adopting a plurality of single-screw pumps in parallel connection). Particularly, in the reaction kettle, a hydrate smashing and stirring paddle is in the form of a propeller blade, and a smashing awl is provided at the bottom of the blade.

Specifically, the gas hydrate multi-scale smashing and slurry fidelity transfer module includes two parts, namely a mixed-phase gas hydrate fidelity transfer pipeline and a water pipeline, wherein the mixed-phase gas hydrate fidelity transfer pipeline consists of following parts connected in sequence: the filter screen 1152, the mixed-phase outlet i of the reaction kettle, a nineteenth shutoff valve V-503, a fourth liquid flowmeter F-501, and an inlet of the circulating pump 121; and the water pipeline consists of following parts connected in sequence: the water tank 113, the seventh shutoff valve V-201, the plunger pump 112, the fifth regulating valve CV-204, a twelfth shutoff valve V-502, and the inlet of the circulating pump 121. After further mixture by means of the circulating pump 121, the two parts are connected with the gas hydrate slurry pipeline conveying characteristic experiment module.

Preferably, the gas hydrate multi-scale smashing and slurry fidelity transfer module further includes a pressure balance detection pipeline for ensuring that pipeline pressure inside the mixed-phase gas hydrate fidelity transfer pipeline keeps consistent with that inside the water pipeline before the mixed-phase gas hydrate is mixed with water. Specifically, the pressure balance detection pipeline is constituted by connecting an outlet e of the pressure stabilizing buffer tank 117 with an intersection between the mixed-phase gas hydrate fidelity transfer pipeline and the water pipeline, and the connecting pipeline is provided with a thirteenth shutoff valve V-501. Before the mixed-phase gas hydrate is mixed with water, first of all, the eleventh shutoff valve V-202 and the thirteenth shutoff valve V-501 are opened so that the mixed-phase gas hydrate fidelity transfer pipeline and the water pipeline maintain consistent in pressure, then the eleventh shutoff valve V-202 and the thirteenth shutoff valve V-501 are closed, and then the mixed-phase gas hydrate is further mixed with water.

The gas hydrate slurry pipeline conveying characteristic experiment module includes the circulating pump 121 (adopting a plurality of single-screw pumps in parallel connection), a vertical pipeline conveying loop, a horizontal pipeline conveying loop, an on-line particle size measuring instrument, a pipeline heater, a high-pressure transparent visible pipe, a plurality of shutoff valves, regulating valves, temperature indicators and pressure indicators. The gas hydrate slurry pipeline conveying loop is connected with the fidelity transfer pipeline via the circulating pump 121 (adopting a plurality of single-screw pumps), at the top of the vertical pipeline section there is provided with an exhaust valve V-604 and a first safety valve V-605, and at the bottom thereof there is provided with a three-phase separator. The horizontal pipeline section is connected with a pressure regulator 124. Particularly, the vertical pipeline conveying loop and the horizontal pipeline conveying loop are respectively provided with an on-line particle size measuring instrument, a pipeline heater and a high-pressure transparent visible pipe; and various parts of the pipeline conveying loops are provided with temperature indicators, pressure indicators and flowmeters.

Specifically, the vertical pipeline conveying loop consists of following parts connected in sequence: a fourteenth shutoff valve V-603, an eighth temperature indicator T-601, an eighth pressure indicator P-601, a ninth temperature indicator T-602, a ninth pressure indicator P-602, the exhaust valve V-604, the first safety valve V-605, a tenth regulating valve CV-606, a tenth pressure indicator P-603, a tenth temperature indicator T-603, an eleventh pressure indicator P-604, an eleventh temperature indicator T-604, a fifteenth shutoff valve V-607, a fifth liquid flowmeter F-602, a third liquid flowmeter F-601 and an eleventh regulating valve CV-602.

The horizontal pipeline conveying loop consists of following parts connected in sequence: the eleventh regulating valve CV-602, a sixteenth shutoff valve V-608, a twelfth regulating valve CV-609, a twelfth pressure indicator P-605, a twelfth temperature indicator T-605, a thirteenth pressure indicator P-606, a thirteenth temperature indicator T-606, a fourteenth temperature indicator T-607, a fourteenth pressure indicator P-607, a fifteenth temperature indicator T-608, a fifteenth pressure indicator P-608, a sixth liquid flowmeter F-603, a seventeenth shutoff valve V-610 and the third liquid flowmeter F-601.

Preferably, the gas hydrate slurry pipeline conveying characteristic experiment module further includes a protection pipeline for protecting the vertical pipeline conveying loop and the horizontal pipeline conveying loop, which protection pipeline consists of following parts connected in sequence:

an outlet of the circulating pump 121, a nineteenth pressure indicator P-609, a thirteenth regulating valve CV-601, the eleventh regulating valve CV-602, the third liquid flowmeter F-601, the pressure regulator 124, and the inlet of the circulating pump 121.

Further, an intersection between the horizontal pipeline conveying loop and the vertical pipeline conveying loop is further connected with the three-phase separator, and a connecting pipeline between the three-phase separator and the intersection is provided with a twenty-first shutoff valve V-611.

The data collection and monitoring and safety control module includes: an environmental simulation control unit, a pressure control unit, a flow metering unit and a smashing parameter control unit which are used for controlling and monitoring pressure, temperature, smashing torque, smashing depth, propelling pressure and rotating speed in the experiment process, for online metering the fluids flow (gas, liquid, and solid mixture of the gas hydrate) in the experiment process of the gas hydrate, further includes an on-line particle size measuring instrument for online measuring particle sizes of the gas hydrate, a pipeline heater for simulating a seawater temperature gradient change in the lifting process of exploited gas hydrate, and the pressure stabilizing buffer tank and the pressure regulator for controlling the pressure of the experimental loop to be constant. The reaction kettle and the pressure stabilizing buffer tank maintain a constant experimental temperature in the experiment process by a refrigerating cycle of the refrigerating units. At the top of the vertical pipeline section there is provided with the exhaust valve V-604 and the first safety valve V-605, at the bottom of the pressure stabilizing buffer tank there is provided with a drain valve, and at the top thereof there is provided with a safety valve.

The output end of the data collection and monitoring and safety control module includes: a resistivity measurement point C, a pressure measurement point P, a temperature measurement point T, a liquid level measurement point L, a single-phase/multiphase fluid flow measurement point F and a motor parameter measurement point M.

The resistivity measurement point C is used for measuring a resistivity of the gas hydrate in the reaction kettle so as to analyze and determine a synthesis effect of the marine gas hydrate, and to display, in real time, a formation process of the hydrate by means of a curve according to a comparison and reference of the captured resistivity curve.

The pressure measurement point P is used for measuring the pressure of the pressure stabilizing buffer tank, the pressure inside the reaction kettle, and the pressure of each pipeline. The pressure of the entire experimental loop system is monitored in real time according to the measurement results to ensure a constant pressure of the experimental loop system in the process of large-amount and rapid preparation of the gas hydrate and of a gas hydrate multi-scale smashing and slurry fidelity transfer. Formation and phase equilibrium state of the gas hydrate in the reaction kettle may be determined by means of change of pressure drop inside the reaction kettle and of a pressure change curve. Fluid flow resistance characteristics of the mixed-phase fluid pipeline conveying (horizontal and vertical) loops may be researched by measuring the pressure of the gas hydrate slurry pipeline conveying experimental loop.

The temperature measurement point T is used for measuring the temperature of the pressure stabilizing buffer tank, the temperature inside the reaction kettle, and the temperature of each pipeline. A constant temperature of the experimental loop system in the process of large-amount and rapid preparation of the gas hydrate and of a gas hydrate multi-scale smashing and slurry fidelity transfer is ensured according to the measurement results. Formation and phase equilibrium state of the gas hydrate in the reaction kettle may be determined by means of change of temperature in the reaction kettle and of a temperature change curve. A seawater temperature gradient change in the lifting process of exploited gas hydrate in the simulation experiment is monitored by measuring the temperature of the gas hydrate slurry pipeline conveying experimental loop, so as to research flow and heat transfer characteristics in the lifting process of exploited marine gas hydrate.

The liquid level measurement point L is used for measuring a liquid height of the pressure stabilizing buffer tank and of the reaction kettle. The measurement results may serve as indicators for determining the water amount to be injected into the reaction kettle in the experiment process and the formed amount of the hydrate.

The single-phase/multiphase fluid flow measurement point F is used for measuring the real-time fluids flow (gas, liquid and mixed phase) flowing through a corresponding pipeline, and consumption of gas and water is determined and calculated, as well as the gas storage capacity of the gas hydrate is researched, according to the measurement results.

The motor parameter measurement point M is used for measuring stirring parameters (for example, rotating speed), smashing parameters (for example, rotating speed for smashing, smashing torque, propelling pressure, smashing depth and smashing pressure), sprayer parameters (for example, spraying angle, spraying rate and liquid drop size) and bubbler parameters (for example, bubbling rate and bubble size) of the stirrer in the reaction kettle. Data obtained from the measurement results may serve as bases of controlling the stirring parameters, the smashing parameters, the sprayer parameters and the bubbler parameters of the smashing stirrer, hereby experimenters may adopt a combination of a bubbling method, a spraying method and a stirring method, and also may adopt one or two methods thereamong to intensify quick formation of the gas hydrate, or research the effect of a certain parameter on large-amount and rapid preparation of the gas hydrate by means of a control of the stirring parameters, the smashing parameters, the sprayer parameters and the bubbler parameters.

1. Preparation of a Hydrate Sample 1.1 Preparation for the Preparation of the Hydrate (1) Water level calibration: an upper head of the reaction kettle is closed, and valves are regulated so that the second drain valve V-203, the sixth shutoff valve V-106, the eighteenth shutoff valve V-301, the first drain valve V-210 and the fifth shutoff valve V-112 are closed, and the seventh shutoff valve V-201, the eleventh shutoff valve V-202, the fifth regulating valve CV-204, the eighth shutoff valve V-205 and the exhaust valve V-111 are opened. The plunger pump 112 is activated to vacuumize the pressure stabilizing buffer tank 17 and the reaction kettle 115 and then fill them with water to establish a standard water level, and the fourth shutoff valve V-104, the eleventh shutoff valve V-202 and the eighth shutoff valve V-205 are closed.

(2) Vacuumization: the first shutoff valve V-101 is closed, meanwhile the exhaust valve V-111, the seventh shutoff valve V-201 and the second drain valve V-203 are closed and other valves are opened, the vacuum pump 116 is activated to vacuumize. When a certain degree of vacuum (measured by the seventh pressure indicator P-301) is achieved, the eighteenth shutoff valve V-301 is closed, and the vacuum pump 116 is turned off. The first shutoff valve V-101 is opened to inject the experimental loop with gas, after which the first shutoff valve V-101 is closed, and the vacuum pump 116 is activated again to vacuumize. The above operations are repeated several times to reduce air amount in the loop.

(3) Gas injection: in the synthetic experiment process of the hydrate, a fidelity transfer loop and a slurry pipeline conveying characteristic test loop are closed, namely, the thirteenth shutoff valve V-501, the twelfth shutoff valve V-502 and the nineteenth shutoff valve V-503 are closed. The first shutoff valve V-101 and the first regulating valve CV-102 are opened to regulate an injection pressure of a methane gas (preventing a safety hazard caused by a methane gas at high pressure and direct stream) so that natural gas having a certain pressure is filled into the loop system.

(4) Water level adjustment: the fifth shutoff valve V-112 and the first drain valve V-210 are regulated, so that the water level of the reaction kettle is depressed to an appropriate water level by natural gas, and then the first drain valve V-210 is closed. The third shutoff valve V-103 and the second drain valve V-203 are regulated, so that the water level of the pressure stabilizing buffer tank 117 is depressed to an appropriate water level by natural gas, and then the second drain valve V-203 is closed.

(5) Water replenishing and pressure boosting: when the loop pressure does not rise anymore, the first shutoff valve V-101 is closed, the seventh shutoff valve V-201 and the eleventh shutoff valve V-202 are opened, and the plunger pump 112 is activated so that water is replenished to the pressure stabilizing buffer tank 117 to boost the pressure. When the pressure stabilizing buffer tank 117 reaches an experimental pressure (measured by the third pressure indicator P-103), the plunger pump 112 is turned off, the seventh shutoff valve V-201 and the eleventh shutoff valve V-202 are closed.

1.2 Operation of Hydrate Synthetic Experiment (1) Refrigeration: the reaction kettle refrigerating unit 123 is activated for water bath refrigeration, for which a constant desired temperature for hydrate formation experiment is set.

(2) Gas circulation: the gas circulation pump 111 is activated, the second regulating valve CV-105 and the third regulating valve CV-108 or the fourth regulating valve CV-109 are regulated, namely, natural gas flow flowing through the reaction kettle 115 meets experiment requirements by means of a main gas circulation and a bypass regulation. Gas is injected from the bottom of the reaction kettle 115, enters the reaction kettle 115 in a bubbling way, and flows out from an upper end cover, thereby forming a circulation.

(3) Stirring: the stirrer 119 is activated, whose rotating speed is set to the experiment requirement suitable for forming the hydrate without destroying an accumulation of the hydrate (a continuously variable speed regulation is ranged from 100 r/min to 400 r/min).

(4) Spraying: the liquid circulation pump 114 is activated, the sixth regulating valve CV-206 and the ninth regulating valve CV-207 or the eighth regulating valve CV-209 are regulated, namely, liquid feed through a nozzle of the upper end cover meets the experiment requirements by means of a main liquid circulation and a bypass circulation.

(5) Pressure stabilizing: the seventh shutoff valve V-201, the eleventh shutoff valve V-202 and the sixth shutoff valve V-106 are opened, the plunger pump 112 is activated to inject water into the pressure stabilizing buffer tank 117 so that the pressure of the loop system is increased, or the sixth shutoff valve V-106 and the second drain valve V-203 are opened to drain water away so that the pressure of the system is reduced. The pressure of the loop system may be measured by the second pressure indicator P-102, the fourth pressure indicator P-104 and the fifth pressure indicator P-105. The pressure of the system remains stable by means of the pressure increasing/reducing operation.

(6) Flow measurement: the second gas flowmeter F-102 and the third gas flowmeter F-103 respectively measure an accumulated flow of methane gas of the inlet and the outlet in the circulation, and gas consumed for forming the hydrate is calculated using the cumulative measurement values (a material balancing calculation method).

(7) Resistivity measurement: four resistivity measurement points C-101 are disposed around the reaction kettle 115, the synthesis effect of the marine gas hydrate is analyzed and determined by means of measured resistivities, and the formation process of the hydrate is displayed in real time by means of a curve according to a comparison and reference of the captured resistivity curve.

(8) Temperature and pressure measurement: the fifth temperature indicator T-105 and the fifth pressure indicator P-105 are disposed around the reaction kettle 115, and the synthesis effect of the marine gas hydrate is analyzed and determined by means of the measured temperature-pressure curve.

(9) Termination: when the prepared marine gas hydrate sample meets the experiment requirements, the gas circulation pump 111 (pressure booster) and the liquid circulation pump 114 are turned off, the sixth shutoff valve V-110, the fifth shutoff valve V-112, the ninth shutoff valve V-212 and the tenth shutoff valve V-211 are closed, and the rapid preparation experiment of the marine gas hydrate is terminated.

(10) Before smashing and fidelity transfer of the marine gas hydrate and until the end of the fidelity transfer, water bath refrigeration for the preparation kettle must be in operation to maintain a constant temperature in the preparation process.

2. Marine Gas Hydrate Smashing and Fidelity Transfer Process 2.1 Water Replenishing, Gas Exhausting and Pre-Cooling the Loop (1) Pre-cooling of the pressure stabilizing buffer tank: allocated amount of water is injected into the pressure stabilizing buffer tank 117, the injected amount of water is ensured to meet a pipeline water consumption, the pressure stabilizing buffer tank refrigerating unit 120 is activated to pre-cool the pressure stabilizing buffer tank 117 to the temperature desired for the experiment.

(2) Devices and instruments inspection: the first shutoff valve V-101, the third shutoff valve V-103, the sixth shutoff valve V-106, the eleventh shutoff valve V-202, the eighth shutoff valve V-205, the eighteenth shutoff valve V-301, the thirteenth shutoff valve V-501, the nineteenth shutoff valve V-503, the twentieth shutoff valve V-604, the first safety valve V-605 and the twenty-first shutoff valve V-611 are closed. The seventh shutoff valve V-201, the fifth regulating valve CV-204, the twelfth shutoff valve V-502, the thirteenth regulating valve CV-601, the eleventh regulating valve CV-602, the fourteenth shutoff valve V-603, the tenth regulating valve CV-606, the fifteenth shutoff valve V-607, the sixteenth shutoff valve V-608, the twelfth regulating valve CV-609 and the seventeenth shutoff valve V-610 are opened and confirmed in open state. The plunger pump 112 is activated to inject water into the loop system. The pressure regulator 124 is regulated, the plunger pump 112 is turned off simultaneously with the seventh shutoff valve V-201 and the eleventh shutoff valve V-202 are closed when the pressure of the system reaches a certain value (measured by the nineteenth pressure indicator P-609). It is checked whether the loop system pipelines, devices and instruments work properly or not.

(3) Water replenishing, gas exhausting and pre-cooling the circulation pipelines of the loop: after it is confirmed that loop system pipelines, devices and instruments work properly, the eleventh shutoff valve V-202, the thirteenth shutoff valve V-501, the exhaust valve V-604 are opened, the plunger pump 112 is activated, and the seventh shutoff valve V-201 is opened to continue injecting water into the loop system so that air in the pipelines are vented from the exhaust valve V-604 (disposed at the top of the circulation pipeline system), heated water is drained away via the exhaust valve V-604 and the first safety valve V-605 so that the pipeline temperature is reduced to a preset value, and then the exhaust valve V-604 and the first safety valve V-605 are closed.

(4) Pressure stabilizing: the seventh shutoff valve V-201, the eleventh shutoff valve V-202 and the thirteenth shutoff valve V-501 are opened, the plunger pump 112 is activated to inject water into the pressure stabilizing buffer tank 117 so that the pressure of the loop system is increased. The pressure (measured by the nineteenth pressure indicator P-609) of the loop system remains stable by regulating the second drain valve V-203 when the pressure desired for the experiment is reached.

(5) Circulation pre-cooling: the liquid circulation pump 114 is activated so that cold water circulates in the loop system and the pressure stabilizing buffer tank 117 and pre-cool the same until the temperature desired for the experiment is reached. Thus, the objective of uniformly pre-cooling the loop system is reached.

2.2 Marine Gas Hydrate Smashing and Fidelity Transfer (1) A motor is disposed inside the reaction kettle 115 and is fixed to the upper head of the reaction kettle 115. The motor is directly connected with a gas hydrate smashing device (the stirrer 119) on which a soft brush is installed. The smashing and stirring of the reaction kettle is in the form of a combination of an anchor type and a propelling type. The device adopts a variable frequency motor and a continuously variable speed controller to perform a rotation of the stirring and smashing paddle, and adopts a two-stage hydraulic cylinder to perform an up-and-down movement of the stirring paddle.

(2) Smashing: the motor is activated so that the gas hydrate smashing device rotates at high speed under the inertia effect and smashes solid hydrate directly formed in the reaction kettle. The motor is shut off to stop smashing when the solid hydrate is smashed to a particle size and concentration range desired for the experiment.

(3) Water injection: valves are regulated so that the eleventh shutoff valve V-202, the thirteenth shutoff valve V-501, the twelfth shutoff valve V-502 and the nineteenth shutoff valve V-503 are closed, and the fifth regulating valve CV-204 and the eighth shutoff valve V-205 are opened. The plunger pump 112 is activated to inject water into the reaction kettle 115 (in the process of water injection, the pressure of the reaction kettle may rise). When the mixture in the reaction kettle 115 reaches a certain liquid level (the liquid level is read by using a radar liquid level meter L-102), the plunger pump 112 is turned off, and then the seventh shutoff valve V-201, the fifth regulating valve CV-204 and the eighth shutoff valve V-205 are closed.

(4) Stirring and mixing: the motor is adjusted so that the gas hydrate smashing device rotates at low speed, thereby achieving an objective of solid particles of the gas hydrate being fully mixed with water.

(5) Forming fidelity transfer channel: the thirteenth shutoff valve V-501 and the exhaust valve V-111 are closed, the third shutoff valve V-103, the fourth shutoff valve V-104, the fifth shutoff valve V-112, the eleventh shutoff valve V-202, the fifth regulating valve CV-204, the twelfth shutoff valve V-502 and the nineteenth shutoff valve V-503 are opened so that the reaction kettle 115 is connected to the circulation pipeline and the pressure stabilizing buffer tank, and fully mixed marine gas hydrate two-phase fluid is abutted with a pipeline-pre-pressed fidelity water pipeline to form a fidelity transfer channel (since the pressure of the reaction kettle is higher than that of the loop system, the marine gas hydrate two-phase fluid and free water can be fully mixed and then directly enter the loop system).

(6) Pressure stabilizing of fidelity transfer loop: an opening ratio of the nineteenth shutoff valve V-503 is regulated, and meanwhile the circulating pump 121 is activated so that marine gas hydrate two-phase fluid is subjected to fidelity transfer in the circulation loop system. At the moment, pre-pressed cold water enters the pressure stabilizing buffer tank, and gas at the top of the pressure stabilizing buffer tank enters the reaction kettle, thereby forming a constant-pressure fidelity transfer loop.

(7) Metering: the flowmeter F-501 meters a slurry flow flowing into the circulation pipeline, the radar liquid level meter L-102 tests the liquid level of the reaction kettle and calculates the amount of hydrate (or the transfer amount of gas hydrate is determined by means of resistance measuring devices disposed around the reaction kettle) transferred into the circulation pipeline. When it is determined that conveying of the hydrate two-phase fluid is completed, the fifth regulating valve CV-204, the twelfth shutoff valve V-502 and the nineteenth shutoff valve V-503 are closed.

(8) Pressure regulating of fidelity transfer loop: the seventh shutoff valve V-201 and the eleventh shutoff valve V-202 are opened, and the plunger pump 112 is activated to inject water into the pressure stabilizing buffer tank 117 to boost the pressure of the loop system, or the second drain valve V-203 is opened to drain water off to reduce the pressure of the system. In this way, the pressure (measured by the nineteenth pressure indicator P-609) of the loop system is maintained stable. So far, the fidelity transfer of the marine gas hydrate is terminated, and the circulating pump runs a next process: marine gas hydrate slurry pipeline conveying characteristic experiment.

3. Marine Gas Hydrate Pipeline Conveying Characteristic Experiment 3.1 Vertical Pipeline Conveying Loop Experiment Process (1) The sixteenth shutoff valve V-608, the seventeenth shutoff valve V-610 and the twenty-first shutoff valve V-611 are closed, the thirteenth regulating valve CV-601, the eleventh regulating valve CV-602, the fourteenth shutoff valve V-603, the tenth regulating valve CV-606 and the fifteenth shutoff valve V-607 are opened.

(2) Flow regulation: the circulating pump 121 is activated so that the gas hydrate two-phase fluid circulates in the loop system. The opening ratio of the thirteenth regulating valve CV-601 and the eleventh regulating valve CV-602 are used cooperatively to regulate the gas hydrate slurry flow entering the vertical pipeline conveying loop, so that flow parameters of the two-phase fluid passing through a vertical visual segment meet the experiment requirements.

(3) Pressure regulation: the pressure regulator 124 is regulated so that the hydrate slurry pipeline conveying characteristic experiment is carried out at different pressure by the circulating pipeline step by step.

(4) Temperature and pressure measuring: drag characteristics of the two-phase fluid flowing upward in a vertical pipeline may be researched by observing the eighth pressure indicator P-601, the ninth pressure indicator P-602, the eighth temperature indicator T-601 and the ninth temperature indicator T-602.

(5) Temperature and pressure measuring: drag characteristics of the two-phase fluid flowing downward in the vertical pipeline may be researched by observing the tenth pressure indicator P-603, the eleventh pressure indicator P-604, the tenth temperature indicator T-603 and the eleventh temperature indicator T-604.

(6) On-line particle size inspection: the on-line particle size measuring instrument (a passive ultrasonic technology such as SanQ™ may be adopted) on the vertical pipeline is utilized to perform online monitoring of particle sizes of the gas hydrate to research flow resistance characteristics in the pipeline conveying and flowing process of the gas hydrate having different particle sizes.

(7) Pipeline heating: the pipeline heater on the vertical pipeline is utilized to simulate a seawater temperature gradient change in the lifting process of exploited gas hydrate so as to research flow and heat transfer characteristics in the lifting process of the exploited marine gas hydrate.

(8) Emergency processing: at the top of the vertical pipeline there is provided with the first safety valve V-605 as an emergency countermeasure for the safety of the experiment circulation pipeline to ensure experiment safety of the circulation pipeline.

3.2 Horizontal Pipeline Conveying Loop Experiment Process (1) The eleventh regulating valve CV-602, the fourteenth shutoff valve V-603 and the fifteenth shutoff valve V-607 are closed; and the thirteenth regulating valve CV-601, the sixteenth shutoff valve V-608, the twelfth regulating valve CV-609 and the seventeenth shutoff valve V-610 are opened.

(2) Flow regulation: the circulating pump 121 is activated so that the gas hydrate two-phase fluid circulates in the loop system. The thirteenth control valve CV-601 and the twelfth control valve CV-609 are used cooperatively to regulate the gas hydrate slurry flow entering the horizontal pipeline conveying loop so that flow parameters of the two-phase fluid passing through a horizontal visual segment meet the experiment requirements.

(3) Pressure regulation: drag characteristics of the two-phase fluid flowing in the horizontal pipeline may be researched by observing the twelfth pressure indicator P-605, the thirteenth pressure indicator P-606, the fourteenth pressure indicator P-607 and the fifteenth pressure indicator P-608.

(4) Temperature and pressure measuring: a viscosity of the two-phase fluid may be tested by observing the twelfth pressure indicator P-605, the thirteenth pressure indicator P-606, the fourteenth pressure indicator P-607, the fifteenth pressure indicator P-608, the twelfth temperature indicator T-605, the thirteenth temperature indicator T-606, the fourteenth temperature indicator T-607 and the fifteenth temperature indicator T-608.

(5) On-line particle size inspection: the on-line particle size measuring instrument (a passive ultrasonic technology such as SanQ™ may be adopted) on the horizontal pipeline is utilized to perform online monitoring of particle sizes of the gas hydrate to research flow resistance characteristics in the pipeline conveying and flowing process of gas hydrate having different particle sizes.

(6) Pipeline heating: the pipeline heater on the horizontal pipeline is utilized to simulate a seawater temperature gradient change in the lifting process of exploited gas hydrate so as to research flow and heat transfer characteristics in the lifting process of the exploited marine gas hydrate.

1. Physical methods for intensifying formation of the gas hydrate for a gas hydrate preparation system may adopt a combination of a bubbling method, a spraying method and a stirring method, and also may adopt one or two methods thereamong to intensify quick formation of the gas hydrate.

2. The gas-phase outlet b of the reaction kettle is connected in sequence with the exhaust valve V-111, the third gas flowmeter F-103, the fifth shutoff valve V-112, the second pressure indicator P-102, the second temperature indicator T-102, the gas circulation pump 111, the second regulating valve CV-105, the fourth pressure indicator P-104, the fourth temperature indicator T-104, the third regulating valve CV-108, the second gas flowmeter F-102, the sixth shutoff valve V-110 and the gas-phase inlet a. The gas circulation pump 111, the second regulating valve CV-105, the fourth pressure indicator P-104, the fourth temperature indicator T-104, the fourth regulating valve CV-109 and the first gas flowmeter F-101 connected in sequence form the gas circulation pipeline. The gas flow of the gas circulation pipeline 111 is metered and monitored by the first gas flowmeter F-101, and the gas flow passing through the gas circulation pump 111 is regulated by cooperatively using the fourth regulating valve CV-109, so that the gas circulation pump 111 is in a safe operation state.

3. The water tank 113 is connected in sequence with the seventh shutoff valve V-201, the plunger pump 112, the fifth regulating valve CV-204, the eighth shutoff valve V-205 and the liquid-phase inlet c of the reaction kettle to constitute a pipeline for feeding liquid to the reaction kettle. The liquid-phase inlet c of the reaction kettle is connected in sequence with the ninth shutoff valve V-212, the sixth regulating valve CV-206, the sixth temperature indicator T-201, the sixteenth pressure indicator P-201, the liquid circulation pump 114, the seventh regulating valve CV-208, the seventh temperature indicator T-202, the seventeenth pressure indicator P-202, the second liquid flowmeter F-202, the eighth regulating valve CV-209, the tenth shutoff valve V-211 and the sprayer 1151 of the reaction kettle to constitute a liquid spraying and circulating pipeline. The eighth shutoff valve V-205 is respectively connected with the liquid-phase inlet c of the reaction kettle and the ninth shutoff valve V-212 through a tee;

The first liquid flowmeter F-201 and the second liquid flowmeter F-202 meter and monitor the liquid flow of the liquid circulation pipeline;

To further ensure that the liquid circulation pump 114 can be safely used, in the present disclosure, a liquid circulation pipeline is designed for the liquid circulation pump 114, and the circulation pipeline of the liquid circulation pump specifically consists of following parts connected in sequence: the outlet of the liquid circulation pump 114, the seventh regulating valve CV-208, the seventh temperature indicator T-202, the seventeenth pressure indicator P-202, the first liquid flowmeter F-201, the ninth regulating valve CV-207, the sixth temperature indicator T-201, the sixteenth pressure indicator P-201, and the inlet of the liquid circulation pump 114. The liquid circulation pipeline is used for regulating the liquid flow passing through the liquid circulation pump 114 by being used cooperatively with the ninth regulating valve CV-207.

4. Stirring parameters (for example, rotating speed), smashing parameters (for example, rotating speed for smashing, smashing torque, propelling pressure, smashing depth and smashing pressure), sprayer parameters (for example, spraying angle, spraying rate and liquid drop size) and bubbler parameters (for example, bubbling rate) of the stirrer in the reaction kettle are controllable.

5. A stirring and smashing paddle of the reaction kettle for preparation of the marine gas hydrate is in the form of a propeller blade, and a smashing awl is provided at the bottom of the blade to simulate a form of a seabed mining vehicle so as to achieve the objective of smashing the hydrate. The stirrer in the reaction kettle for the marine gas hydrate adopts a variable frequency motor and a continuously variable speed reducer to perform rotation of the stirring and smashing paddle and adopts a two-stage hydraulic cylinder to perform an up-and-down movement of the stirring paddle.

6. The reaction kettle is provided with the liquid flowmeter L-102. A material level meter (for example, a radar liquid level meter) available for non-contact measurement may be selected for measurement since a direct measurement is unavailable for an experimental material usage amount, a material formation amount and a hydrate formation amount in the high-pressure reaction kettle.

7. Four resistivity measurement points C-101 are disposed around the reaction kettle 115 to analyze and determine a synthesis effect of the marine gas hydrate by means of measured resistivities, and to display, in real time, a formation process of the hydrate by means of a curve according to a comparison and reference of the captured resistivity curve. Temperature and pressure measuring elements are disposed around the reaction kettle to analyze and determine the synthesis effect of the marine gas hydrate by means of a measured pressure-temperature curve.

8. Replenishment amount of gas in the synthesis process of the gas hydrate is metered by the liquid level meter L-101 of the pressure stabilizing buffer tank. Replenishment amount of gas in the reaction kettle before the synthesis of the gas hydrate is metered by the second gas flowmeter F-102. The flow of liquid before the synthesis of the gas hydrate is metered by the second liquid flowmeter F-202, and a gas storage capacity of the gas hydrate is synthetically calculated using the measured flow data.

9. Stability and regulation of the pressure of the experimental loop system, in the process of gas hydrate large-amount and rapid preparation and of gas hydrate multi-scale smashing and slurry fidelity transfer, may be achieved by means of the second drain valve V-203 of the pressure stabilizing buffer tank.

(1) When the gas pressure of an experiment gas circulation loop is too high, the loop pressure needs to be reduced, thus the first shutoff valve V-101 needs to be closed, the third shutoff valve V-103 and the eighteenth shutoff valve V-301 are opened, the vacuum pump 116 is activated to slowly pull gas out of the pressure stabilizing buffer tank 117 so that the loop pressure is gradually reduced. When the loop pressure reaches the pressure desired for the experiment, the eighteenth shutoff valve V-301 is closed and the vacuum pump 116 is turned off in sequence to achieve the objective of reducing the pressure of the gas circulation loop. At the moment, the seventh pressure indicator P-301 indicates a pressure value of the vacuum pump, and the third pressure indicator P-103 and the third temperature indicator T-103 respectively indicate a pressure value and a temperature value of the pressure stabilizing buffer tank 117. Meanwhile the second safety valve V-107 provided at the top of the pressure stabilizing buffer tank 117 serves as a loop pressure overload protection in the experiment process. When the gas pressure of the experiment gas circulation loop is too high, superfluous water in the pressure stabilizing buffer tank may be drained off via the second drain valve V-203 provided at the bottom of the pressure stabilizing buffer tank, thereby achieving the objective of reducing the pressure of the gas circulation loop.

(2) When the gas pressure of the experiment gas circulation loop is too low, meanwhile the pressure of the gas cylinder is lower than the pressure desired for the experiment. To stabilize the pressure of the gas circulation loop, the third shutoff valve V-103, the eleventh shutoff valve V-202 and the seventh shutoff valve V-201 need to be opened, and subsequently the plunger pump 112 is activated to pump water in the water tank into the pressure stabilizing buffer tank 117. Gas in the gas circulation loop is compressed utilizing gas compressibility so that the loop pressure gradually rises as the amount of liquid pumped by the plunger pump 112 gradually increases. When the pressure desired for the experiment is reached, the seventh shutoff valve V-201 is closed and the plunger pump 112 is turned off as well as the eleventh shutoff valve V-202 is closed in sequence to achieve the objective of stabilizing the pressure of the gas circulation loop. At the moment, the eighteenth pressure indicator P-203 indicates a pressure value of the plunger pump, and the third pressure indicator P-103 and the third temperature indicator T-103 respectively indicate a pressure value and a temperature value of the pressure stabilizing buffer tank.

10. The refrigerating unit providing a refrigerating effect for the reaction kettle and the pressure stabilizing buffer tank in the experiment process has two functions, namely refrigerating and heating.

11. The diameter of the mixed-phase outlet i of the reaction kettle is larger than the pipeline diameter to ensure a smooth fidelity transfer of the gas hydrate slurry. Furthermore, at the mixed-phase outlet i there is provided with a filter screen 1152 for filtering solid gas hydrate lumps not reaching particle sizes desired for gas hydrate fidelity transfer and pipeline conveying, and for recrushing until reaching the particle sizes desired for gas hydrate fidelity transfer and pipeline conveying, and thereby the objective of preventing from pipeline blockage is achieved.

12. A gas hydrate slurry pipeline conveying characteristic experiment pipeline is provided with a pressure regulator 124 for regulating the experimental pressure in the process of gas hydrate slurry pipeline conveying.

13. The gas hydrate slurry pipeline conveying characteristic experiment pipeline (a horizontal pipeline section and a vertical pipeline section) is provided with a high-pressure visible pipe (adopting a transparent quartz glass pipe) and is also provided with an on-line particle size measuring instrument for online monitoring the particle sizes of the gas hydrate, and a pipeline heater for simulating the seawater temperature gradient change in the lifting process of exploited gas hydrate, respectively.

14. At the top of the vertical pipeline section of the gas hydrate slurry pipeline conveying characteristic experiment pipeline there is provided with an exhaust valve V-604 for exhausting gas in the pipeline during a preparation stage prior to the experiment, and at the top of the vertical pipeline section there is also provided with a first safety valve V-605 for emergency processing any emergency circumstances in the experiment process.

Finally, it should be appreciated that the foregoing embodiments are merely intended for describing the technical solutions of the present disclosure, but not for limiting the present disclosure. Although the present disclosure is described in detail with reference to the foregoing embodiments, persons of ordinary skilled in the art should understand that modifications to the technical solutions described in the foregoing embodiments or equivalent replacements to at least some of technical features thereof can be made without departing from the spirit and scope of the technical solutions of the embodiments of the present disclosure.

The invention claimed is:

1. An experimental loop system for fluidization exploitation of solid-state marine gas hydrate, comprising: four modules, namely a gas hydrate sample large-amount and rapid preparation module, a gas hydrate multi-scale smashing and slurry fidelity transfer module, a gas hydrate slurry pipeline conveying characteristic experiment module and a data collection and monitoring and safety control module; wherein the gas hydrate sample large-amount and rapid preparation module comprises a gas conveying pipeline, a liquid conveying pipeline, a spraying device, a bubbling device, and a stirring device;

wherein the gas conveying pipeline is used for conveying gas in a gas cylinder into a reaction kettle, and the gas conveying pipeline is connecting an outlet of the gas cylinder with a gas inlet (a) at a bottom of the reaction kettle;

the liquid conveying pipeline is used for conveying water in a water tank into the reaction kettle, and the liquid conveying pipeline on which a plunger pump is disposed, is connecting an outlet of the water tank with a liquid-phase inlet (c) of the reaction kettle;

the spraying device comprises a sprayer disposed at a top of the reaction kettle, and the sprayer is communicated with the liquid-phase inlet (c) of the reaction kettle through a pipeline on which a liquid circulation pump is disposed;

the bubbling device comprises a bubbler disposed at a bottom inside the reaction kettle;

the stirring device is provided with a stirrer in the reaction kettle, a stirring and smashing paddle of the stirrer is in the form of a propeller blade, and a smashing awl is provided at a bottom of the blade;

the gas hydrate multi-scale smashing and slurry fidelity transfer module comprises two parts, namely a mixed-phase gas hydrate fidelity transfer pipeline and a water pipeline, wherein the mixed-phase gas hydrate fidelity transfer pipeline is connecting a mixed-phase outlet (i) of the reaction kettle with an inlet of a circulating pump, the water pipeline is connecting the water tank with the inlet of the circulating pump, and after further mixing by means of the circulating pump, the two parts are connected with the gas hydrate slurry pipeline conveying characteristic experiment module;

the gas hydrate slurry pipeline conveying characteristic experiment module comprises a vertical pipeline conveying loop and a horizontal pipeline conveying loop;

the vertical pipeline conveying loop comprises a vertical pipeline connected with an outlet of the circulating pump, the horizontal pipeline conveying loop comprises a horizontal pipeline connected with the outlet of the circulating pump, and the vertical pipeline conveying loop and the horizontal pipeline conveying loop are respectively provided with an on-line particle size measuring instrument, a pipeline heater and a high-pressure transparent visible pipe; and the data collection and monitoring and safety control module comprises a computer and a resistivity measurement point C, a pressure measurement point P, a temperature measurement point T, a liquid level measurement point L, a single-phase/multiphase fluid flow measurement point F and a motor parameter measurement point M that are connected with the computer.

2. The experimental loop system for fluidization exploitation of solid-state marine gas hydrate according to claim 1, wherein the gas conveying pipeline comprises a gas bypass regulating circulation loop for pumping out unreacted gas in the reaction kettle from a gas outlet b at a top of the reaction kettle back into the gas inlet a at the bottom of the reaction kettle by means of a gas circulation pump.

3. The experimental loop system for fluidization exploitation of solid-state marine gas hydrate according to claim 2, wherein the gas bypass regulating circulation loop is provided with a gas protection circulation loop for protecting the gas circulation pump, and the gas protection circulation loop consists of following parts connected in sequence: an outlet of the gas circulation pump a second regulating valve (CV-105), a fourth pressure indicator (P-104), a fourth temperature indicator, a fourth regulating valve, a first gas flowmeter, a second pressure indicator, a second temperature indicator, and an inlet of the gas circulation pump.

4. The experimental loop system for fluidization exploitation of solid-state marine gas hydrate according to claim 1, wherein the spraying device comprises a protection circulation loop for protecting the liquid circulation pump, and the protection circulation loop specifically consists of following parts connected in sequence: an outlet of the liquid circulation pump, a seventh regulating valve, a seventh temperature indicator, a seventeenth pressure indicator, a first liquid flow meter, a ninth regulating valve, a sixth temperature indicator, a sixteenth pressure indicator, and an inlet of the liquid circulation pump.

5. The experimental loop system for fluidization exploitation of solid-state marine gas hydrate according to claim 1, wherein the gas hydrate sample large-amount and rapid preparation module comprises a pressure stabilizing pipeline for maintaining pressure inside the reaction kettle to be constant or to be in a desired pressure condition, and the pressure stabilizing pipeline consists of two parts, namely a liquid-phase pipeline and a gas-phase pipeline; wherein the liquid-phase pipeline consists of following parts connected in sequence through pipelines: the water tank, the plunger pump, a liquid-phase inlet (d) and a liquid-phase outlet (h) at a bottom of a pressure stabilizing buffer tank, and a second drain valve; and the gas-phase pipeline consists of following parts connected in sequence through pipelines: the outlet of the gas cylinder, a gas-phase inlet f at a top of the pressure stabilizing buffer tank, a gas-phase outlet (g) of the pressure stabilizing buffer tank, and the gas inlet (a) at the bottom of the reaction kettle.

6. The experimental loop system for fluidization exploitation of solid-state marine gas hydrate according to claim 5, wherein the pressure stabilizing buffer tank is further connected with a vacuum pump.

7. The experimental loop system for fluidization exploitation of solid-state marine gas hydrate according to claim 1, wherein the mixed-phase gas hydrate fidelity transfer pipeline further comprises a filter screen disposed at the mixed-phase outlet (i) of the reaction kettle.

8. The experimental loop system for fluidization exploitation of solid-state marine gas hydrate according to claim 1, wherein the gas hydrate multi-scale smashing and slurry fidelity transfer module further comprises a pressure balance detection pipeline for ensuring that pipeline pressure inside the mixed-phase gas hydrate fidelity transfer pipeline keeps consistent with that inside the water pipeline before the mixed-phase gas hydrate is mixed with water; and the pressure balance detection pipeline is constituted by communicating an outlet (e) of the pressure stabilizing buffer tank with an intersection between the mixed-phase gas hydrate fidelity transfer pipeline and the water pipeline.

9. The experimental loop system for fluidization exploitation of solid-state marine gas hydrate according to claim 1, wherein the gas hydrate slurry pipeline conveying characteristic experiment module further comprises a protection pipeline for protecting the vertical pipeline conveying loop and the horizontal pipeline conveying loop, which protection pipeline consists of following parts connected in sequence:

the outlet of the circulating pump, a nineteenth pressure indicator, a thirteenth regulating valve, an eleventh regulating valve, a third liquid flowmeter, a pressure regulator, and the inlet of the circulating pump.

10. The experimental loop system for fluidization exploitation of solid-state marine gas hydrate according to claim 1, wherein an intersection between the horizontal pipeline conveying loop and the vertical pipeline conveying loop is further connected with a three-phase separator.

* * * * *